US006626238B2

(12) United States Patent
Hooper

(10) Patent No.: US 6,626,238 B2
(45) Date of Patent: Sep. 30, 2003

(54) REMOTE SENSOR FOR DETERMINING PROPER PLACEMENT OF ELEVATOR SLIPS

(75) Inventor: Robert C. Hooper, Lafayette, LA (US)

(73) Assignee: Offshore Energy Services, Inc., Broussard, LA (US)

( * ) Notice: Subject to any disclaimer, the term of this patent is extended or adjusted under 35 U.S.C. 154(b) by 20 days.

(21) Appl. No.: 10/021,391

(22) Filed: Dec. 12, 2001

(65) Prior Publication Data

US 2003/0106684 A1 Jun. 12, 2003

(51) Int. Cl.[7] ..... E21B 47/00
(52) U.S. Cl. ..... 166/66; 166/77.52
(58) Field of Search ..... 166/66, 77.52, 166/255.1, 250.01, 64

(56) References Cited

U.S. PATENT DOCUMENTS 3,882,377 A * 5/1975 Kelly ..... 324/261
4,269,554 A * 5/1981 Jackson ..... 414/22.63
4,604,724 A * 8/1986 Shaginian et al. ..... 700/213
4,676,312 A 6/1987 Mosing et al.
5,791,410 A 8/1998 Castille et al.
5,848,647 A 12/1998 Webre et al.
5,909,768 A 6/1999 Castille et al.
6,073,699 A 6/2000 Hollingsworth, Jr.
2002/0170720 A1 * 11/2002 Haugen ..... 166/379

* cited by examiner

*Primary Examiner*—Hoang Dang
(74) *Attorney, Agent, or Firm*—Ted M. Anthony

(57) ABSTRACT

An apparatus for installing pipe such as large diameter casing in a wellbore. Sensors are positioned at a predetermined location at or near the upper surface of elevators suspended from a rig traveling block. As elevators are lowered over a section of pipe, such sensors provide a signal indicating that the elevators are positioned a desired distance below the top of the pipe. The signal alerts an operator that elevators are positioned properly relative to a pipe body so that slips within the elevators will be properly engaged against the outer surface of the pipe and not a connection upset or large diameter external coupling.

14 Claims, 6 Drawing Sheets

REMOTE SENSOR FOR DETERMINING PROPER PLACEMENT OF ELEVATOR SLIPS

CROSS REFERENCES TO RELATED APPLICATIONS

None

STATEMENTS AS TO RIGHTS TO INVENTIONS MADE UNDER FEDERALLY SPONSORED RESEARCH AND DEVELOPMENT

None

BACKGROUND OF THE INVENTION

1. Field of the Invention

The present invention relates to an apparatus for installing pipe in a wellbore, such as an oil or gas well. More particularly, this invention relates to an apparatus for determining when movable elevators in a drilling rig are properly positioned relative to a section of pipe to be installed in a wellbore. More particularly still, this invention relates to an apparatus which can provide a signal when elevators, and more specifically the slips of such elevators, are positioned at a desired location relative to a section of pipe to be installed in a wellbore and, conversely, when such elevators and slips are not so positioned. More particularly still, the present invention relates to an apparatus which can be used to prevent elevator slips from being closed when such elevator slips are improperly positioned relative to a section of pipe to be installed in a wellbore.

2. Description of the Related Art

Standard rotary drilling rigs are typically comprised of a supportive rig floor, a derrick extending vertically above said rig floor, and a traveling block which can be raised and lowered within said derrick. During drilling operations, such rig equipment is often used to insert and, in some cases remove, tubular goods from a well situated under such derrick. For example, drill bits and/or other equipment are often lowered into a well and manipulated within such well via tubular drill pipe. Moreover, once a well has been drilled to a desired depth, large diameter pipe called casing is often installed in the wellbore and cemented in place in order to provide structural integrity to the well and to isolate downhole formations from one another.

When installing casing, drill pipe or other pipe into a well, such pipe is typically installed in a number of sections of roughly equal length. These pipe sections, often called "joints," are typically installed one at a time, and screwed together or otherwise joined end-to-end to make a roughly continuous length of pipe. In order to start the process of inserting pipe in a well, a first joint of pipe is lowered into the wellbore at the rig floor, and suspended in place using a set of "lower slips." Such lower slips are often wedge-shaped dies which can be inserted between the outer surface of said pipe and the bowl-like inner profile of the rotary table. Such lower slips hold the weight of the pipe and suspend the pipe in the well. Although such lower slips can be automated, in many applications such lower slips are manually inserted and removed by rig personnel.

During the process of installing pipe into a well, a first joint of pipe is generally inserted into a well and positioned so that the top of said joint of pipe is located a few feet above the rig floor. A rig crew or a pipe handling machine grabs a second joint of pipe, lifts said second joint of pipe vertically into the derrick, positions said second joint above the first joint which was previously run into the well, and "stabs" a male or "pin-end" thread at the bottom of said second joint into a female or "box-end" thread at the top of the first joint. The second joint is then rotated in order to mate the threaded connections of the two joints together.

Thereafter, a set of elevators attached to the traveling block in the rig derrick is typically lowered over the top of the second (i.e., upper) joint of pipe. Such elevators have a central bore which is aligned with the uppermost end of the joint of pipe. The pipe is received within the central bore of the elevators. Once the elevators have been lowered over the pipe a desired distance, slips within such elevators can be activated to latch or grip around the outer surface of said joint pipe. Depending on the length of the second joint of pipe, this can often occur 40 feet or more above the rig floor.

Once the elevator slips are properly latched and engaged around the body of the pipe, the traveling block and elevators can be raised to take weight off of the lower slips. The lower slips can then be removed. Once the lower slips are removed, the entire weight of the pipe string is suspended from the elevator slips. The pipe can then be lowered into the well by lowering the traveling block. After the second or upper joint of pipe is lowered a sufficient distance into the well, the lower slips are again inserted in place near the rig floor. The process is repeated until the desired length of pipe (i.e., the desired number of joints of pipe) is inserted into the wellbore. This same process is typically utilized for many different types and sizes of pipe whether small diameter drill pipe or large diameter casing.

At certain points during this process, the entire weight of the pipe is being held or suspended by the elevators and, more specifically, the elevator slips. This pipe can be very heavy, especially when many joints of large diameter and/or heavy-wall casing are being run into a well. Accordingly, it is extremely important that the elevator slips must be properly latched around the uppermost section of pipe in the derrick to ensure that such pipe remains securely positioned within said elevators. If the pipe is not properly secured within such elevators, it is possible that the pipe could drop or fall out of the elevators, thereby causing damage to the rig or the well, or injury to rig personnel.

In many cases, a female or box-end threaded connection of a joint of pipe includes an "upset," whereby said connection has a larger outer diameter than the rest of the pipe body. In other instances, pipe joints are joined together using internally threaded couplings; such couplings also have a larger outer diameter than the remainder of the pipe body. In either case, care must be taken to ensure that elevator slips, which are designed to engage against the outer surface of a pipe body (as opposed to the coupling or connection upset), are indeed aligned with said pipe body. If such elevator slips are inadvertently closed against a coupling or connection upset, such slips likely will not fully contact or engage against the outer surface of the pipe. This is true even when such slips are partially aligned with a connection upset or coupling. As a result, slips (including elevator slips) which are not properly engaged against a pipe body may not grip such pipe securely. If the slips do not grip the pipe securely, such slips may not be able to support the weight of the pipe string, and the pipe can fall out of the slips.

In one common method of installing or running casing into a wellbore, a worker is stationed on a platform in the derrick at approximately the height where elevator slips are closed on the top of a section of pipe, which can often be approximately forty (40') feet or more above the rig floor.

The worker, often referred to as a "derrick man," visually observes when the elevators have been properly lowered over the top of a section of pipe and positioned relative to said section of pipe. The driller, who is located on the drill floor, controls the vertical positioning of the traveling block and the elevators attached thereto. Once the derrick man observes that the elevators are properly positioned relative to the body of the section of pipe (that is, that the elevator slips are not positioned adjacent to a connection upset or external coupling) the derrick man typically uses shouts or hand signals to communicate this fact to the driller. The elevator slips are then latched around the body of the pipe. Thereafter, the driller can pick up on the traveling block thereby lifting the entire weight of the pipe. In some cases, this positioning of the elevators relative to the uppermost section of pipe is determined or confirmed using one or more closed-circuit video cameras mounted in the derrick which can provide a video image of such elevators to personnel located on the rig floor or at other locations on the rig.

It is often very difficult for a driller or other operator situated on the rig floor to determine whether elevators are properly positioned relative to the top of a joint of pipe suspended in the derrick without some assistance from a derrick man or other device. First, a distance of 40' or more typically separates the rig floor from the top of the pipe joint where the elevators must be latched. Second, in many instances, the driller's perspective makes such task difficult because he must look virtually straight up to see the position of elevators. As a result, it is frequently difficult for someone standing at the rig floor to judge the actual position of the elevators relative to the pipe joint.

Furthermore, it is also often difficult for a derrick man to judge when elevators are properly positioned relative to a joint of pipe suspended in a derrick. Even though the derrick man may be positioned on an elevated platform in the derrick, he still may not be close enough to the top of the pipe to accurately determine when the elevators have cleared the connection upset or external coupling. Moreover, even if the derrick man can see when the elevators are properly positioned on said joint of pipe, there is always a risk of miscommunication between the derrick man and the driller, especially when shouts or hand signals are used.

Accordingly, it is an object of the present invention to provide a means for determining when elevators, and more particularly the slips of such elevators, are positioned in a desired location relative to the top of a section of pipe to be gripped by said elevators. Further, it is an object of the present invention to provide a means for signaling to a driller and/or other rig personnel when such elevator slips are properly positioned relative to a section of pipe to be gripped by said elevators. Likewise, it is an object of this invention to provide a means for signaling to a driller and/or other rig personnel when elevator slips have passed over a connection upset or external coupling, such that said slips are located adjacent to the body of a section of pipe and, therefore, in a proper position to grip or fully engage against such pipe.

SUMMARY OF THE INVENTION

The present invention relates to a device which can determine when a set of elevators is properly positioned relative to a section of pipe to be gripped by the slips of such elevators. The present invention uses one or more sensors to determine when a set of elevators, and more particularly the slips of such elevators, are properly positioned relative to a section of pipe suspended in a derrick. In the preferred embodiment of the present invention, such sensors are optical sensors, such as an electric eye, mounted at or near the top of such elevators. Such optical sensors are mounted a predetermined distance above the upper surface of the elevators. The optical sensors are used to determine whether such elevators are properly positioned near the top of the pipe to be gripped by the elevator slips.

Generally, elevators have a central bore extending through the body of said elevators. When such elevators are lowered around a joint of pipe to be latched, the pipe itself is received within said central bore of the elevators. As the pipe passes through the central bore of such elevators, it eventually protrudes through the upper opening of said central bore near the upper surface of the elevators.

In the preferred embodiment of the present invention, one or more optical sensors are situated on the upper surface of the elevators near the upper opening of the central bore of the elevators. The sensors emit a beam of light or other optical signal which crosses the upper opening of said central bore. As the elevators are lowered along the length of the pipe, the top of the pipe eventually protrudes through the upper opening of the central bore and breaks the optical signal emitted between the optical sensors. Put another way, the optical sensors recognize when the elevators have progressed far enough down the length of a joint of pipe to ensure that said elevators are not positioned adjacent to a connection upset or coupling. Once said elevators are properly positioned, the elevator slips can be latched to fully grip and engage against the body of the pipe.

When the signal emitted by the optical sensors is broken, a signal (sound and/or visual) is sent to the driller or other operator at the rig floor, thereby indicating that the elevator slips have cleared the connection upset and/or coupling, and that the elevators are in the desired position. The elevator slips can then be actuated to close against the pipe body and grip said pipe. The system can also be automated to prevent the elevator slips from latching unless the appropriate signal is received from the sensing means mounted above the elevators.

DESCRIPTION OF THE PREFERRED EMBODIMENT(S)

Figure 1:
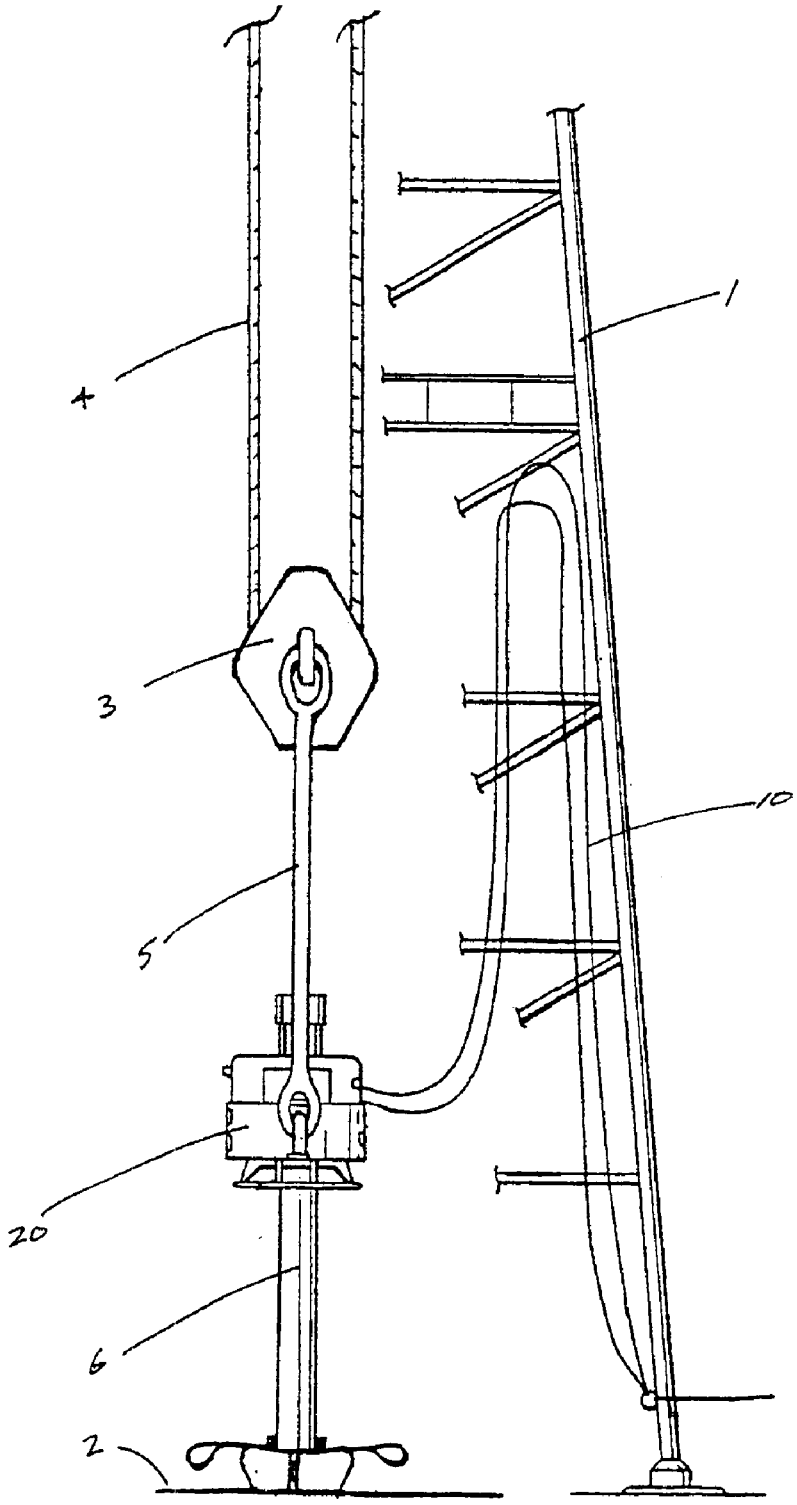
FIG. 1 is a side view of a set of elevators latched to a section of pipe which is suspended within a derrick and partially inserted into a well.

Referring to FIG. 1, a standard configuration of equipment on a drilling rig used for running pipe into a wellbore, and for pulling pipe out of said wellbore, is shown. Derrick 1 extends above the rig floor 2 and supports traveling block 3 via drill line 4. Bails 5 are used to support pipe handling elevators 20 from traveling block 3. A driller or other operator, typically positioned on or near rig floor 2, operates drawworks on said rig, thereby causing traveling block 3 to be vertically raised and/or lowered within derrick 1 as desired. Accordingly, by raising and lowering said traveling block 3 via drill line 4, elevators 20 can be positioned at desired vertical locations within derrick 1.

Still referring to FIG. 1, elevators 20 are shown latched on the upper portion of pipe joint 6. Elevators 20 have a central bore therethrough; pipe joint 6 is received within said central bore of elevators 20. Elevators 20 can be positioned at desired locations along the length of the upper portion of pipe joint 6 by being raised or lowered via traveling block 3.

Figure 1A:
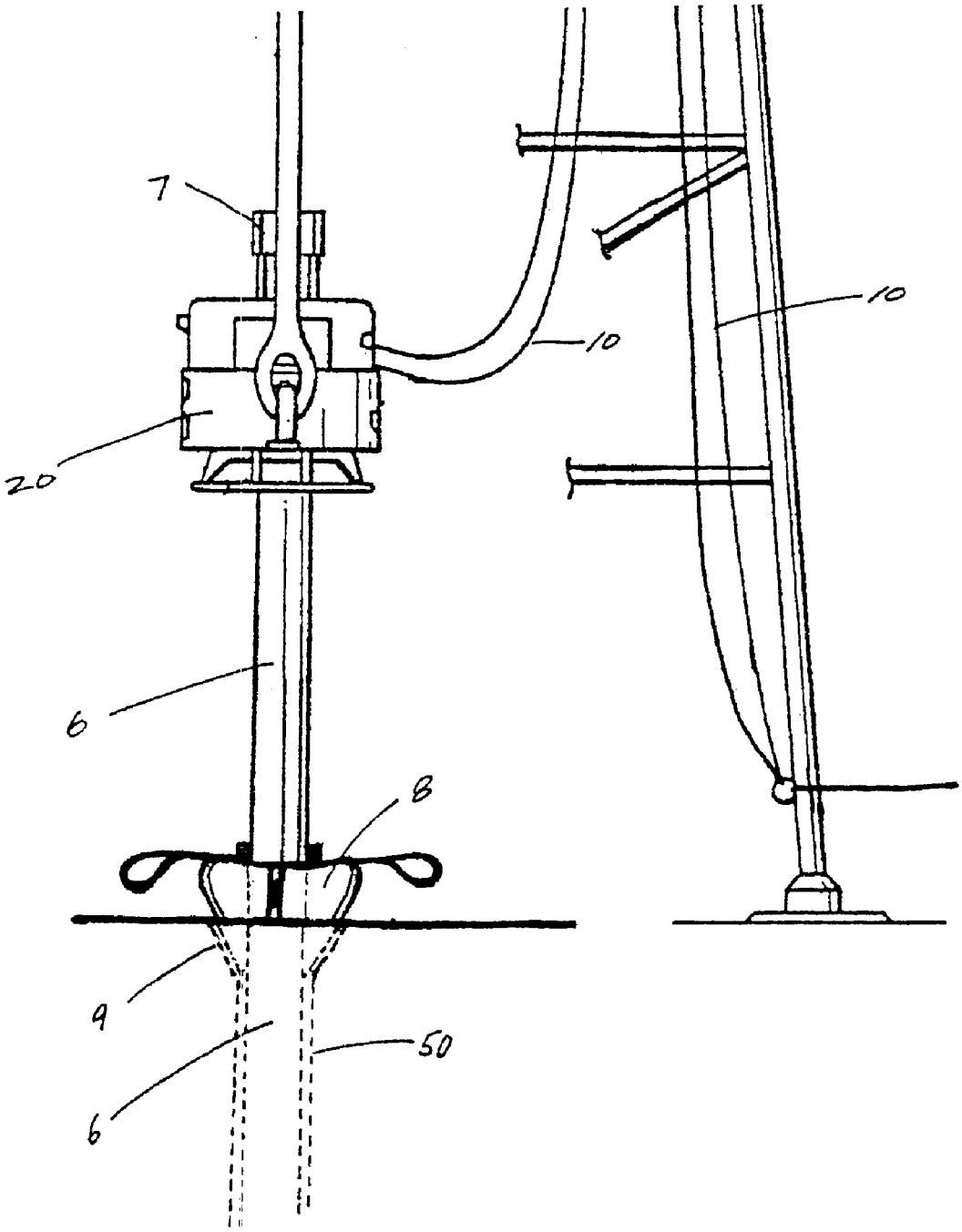
FIG. 1*a* is a side partial cut-away view of a set of elevators latched to a section of pipe which is partially inserted into a well.

FIG. 1*a* presents a very similar view as FIG. 1, except that FIG. 1*a* includes a partial cut-away view depicting pipe joint 6 extending into a well 50. External coupling 7, having a larger outer diameter than the tube body of pipe joint 6, is screwed on external threads at the upper end of pipe joint 6. Lower slips 8 are used to support the weight of pipe joint 6, as well as any other sections of pipe attached thereto. Lower slips 8 are disposed within a bowl formed by rotary table 9. Said lower slips 8 essentially wedge between rotary table 9 and the outer surface of pipe joint 6, and thus engage against the outer surface of pipe joint 6. In this configuration, lower slips 8 can support the entire weight of pipe joint 6, as well as any pipe attached to and suspended below pipe joint 6.

Elevators 20 contain internal slips which function in a manner which is similar to lower slips 8. Such internal slips typically utilize movable wedge-shaped dies which can seat within a bowl, in much the same way that lower slips 8 seat within rotary table 9 and engage around the outer surface of pipe joint 6. In the preferred embodiment, such elevator slips are actuated, that is, moved in and out of said elevator bowl using pneumatic power. Pneumatic lines 10 are depicted in FIG. 1 and FIG. 1*a* as being connected to elevators 20. Said pneumatic lines 10 run to a power source and serve to provide power for actuation of elevator slips 21 (not depicted in FIGS. 1 and 1*a*).

Figure 2:
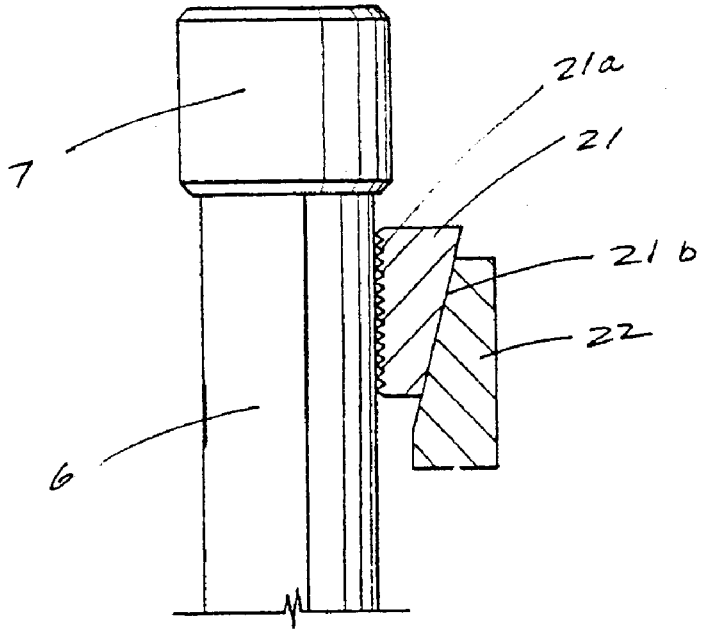
FIG. 2 is a side view of slips properly seated within a bowl to fully engage against a pipe body.

FIG. 2 depicts an isolated side view of slips located within elevators 20 which are used to grip the outer surface of a joint of pipe such as pipe joint 6. Elevator slips 21 are depicted as being properly seated within elevator bowl 22 to fully engage against the outer surface of pipe joint 6. External pipe coupling 7 has a larger outer diameter than the body of pipe joint 6. Elevator slips are specifically sized to fit around the outer diameter of the tube body of pipe joint 6. Because external coupling 7 has a larger outer diameter than the tube body of pipe joint 6, slips 21 are prevented from fully receding within bowl 22 when said slips are closed on external coupling 7.

Elevator slips 21 have gripping surface 21*a* with friction enhancing teeth, as well as tapered edge 21*b*. When elevator slips 21 are properly seated within bowl 22, tapered edge 21*a* is fully received within bowl 22, thereby causing gripping surface 21*a* to become engaged against the outer surface of pipe joint 6. In effect, elevator slips 21 become wedged between bowl 22 and pipe joint 6. In this position, when elevator slips 21 are fully engaged against the outer surface of pipe joint 6, elevators 20 are capable of fully supporting the weight of pipe joint 6, together with any additional pipe which may be attached therebelow.

Figure 3:
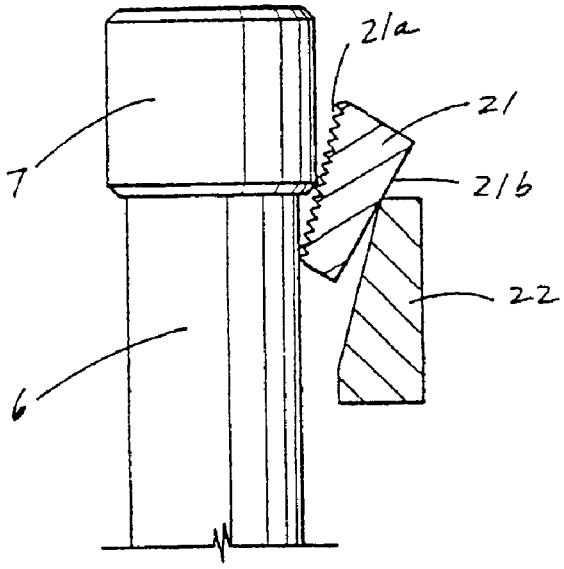
FIG. 3 is a side view of slips which are improperly seated within a bowl, and therefore not fully engaged against a pipe body, due to alignment of the slips with an external pipe coupling.

FIG. 3 depicts an alternative view of the elements shown in FIG. 2. In FIG. 3, elevator slips 21 are aligned with external coupling 7, rather than tube body of pipe joint 6. In this position, elevator slips 21 are not fully received within bowl 22 of elevator 20. As such, gripping surface 21*a* of slips 21 does not fully engage against the outer surface of pipe joint 6 or external coupling 7. Because elevator slips 21 are not fully engaged against the outer surface of pipe joint 6 or external coupling 7, such slips 21 do not fully grip such pipe. Accordingly, such slips would most likely not be able to support the full weight of pipe joint 6 and/or any pipe attached thereto and suspended therebelow.

Figure 4:
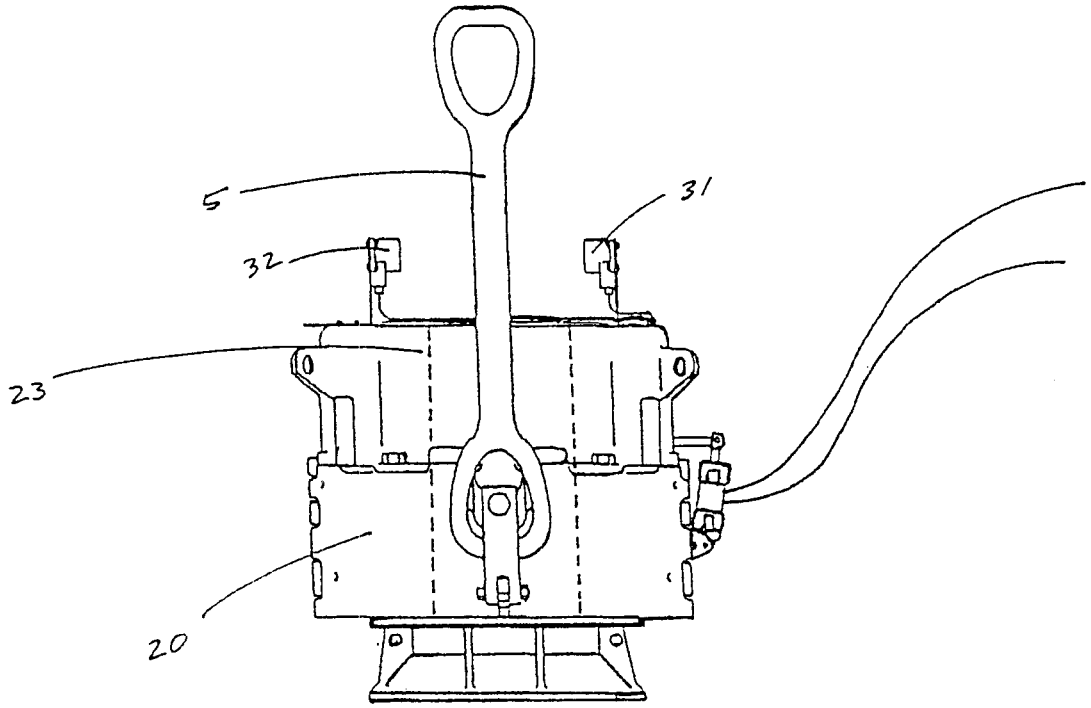
FIG. 4 is a side view of a set of elevators positioned above a section of pipe.
Figure 4:
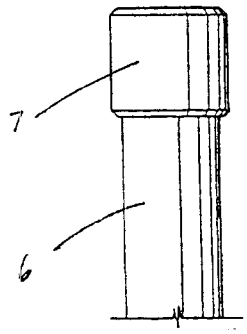

FIG. 4 depicts a side view of elevators 20 employing the present invention suspended immediately above pipe joint 6. External coupling 7 is attached to the upper end of said pipe joint 6. External coupling 7 has a greater outer diameter than the outer diameter of the tube body of pipe joint 6. The lower end of bails 5 is attached to elevators 20. Although not depicted in FIG. 4, the upper end of bails 5 is attached to a traveling block of a drilling rig (such as traveling block 3 shown in FIG. 1.)

Figure 5:
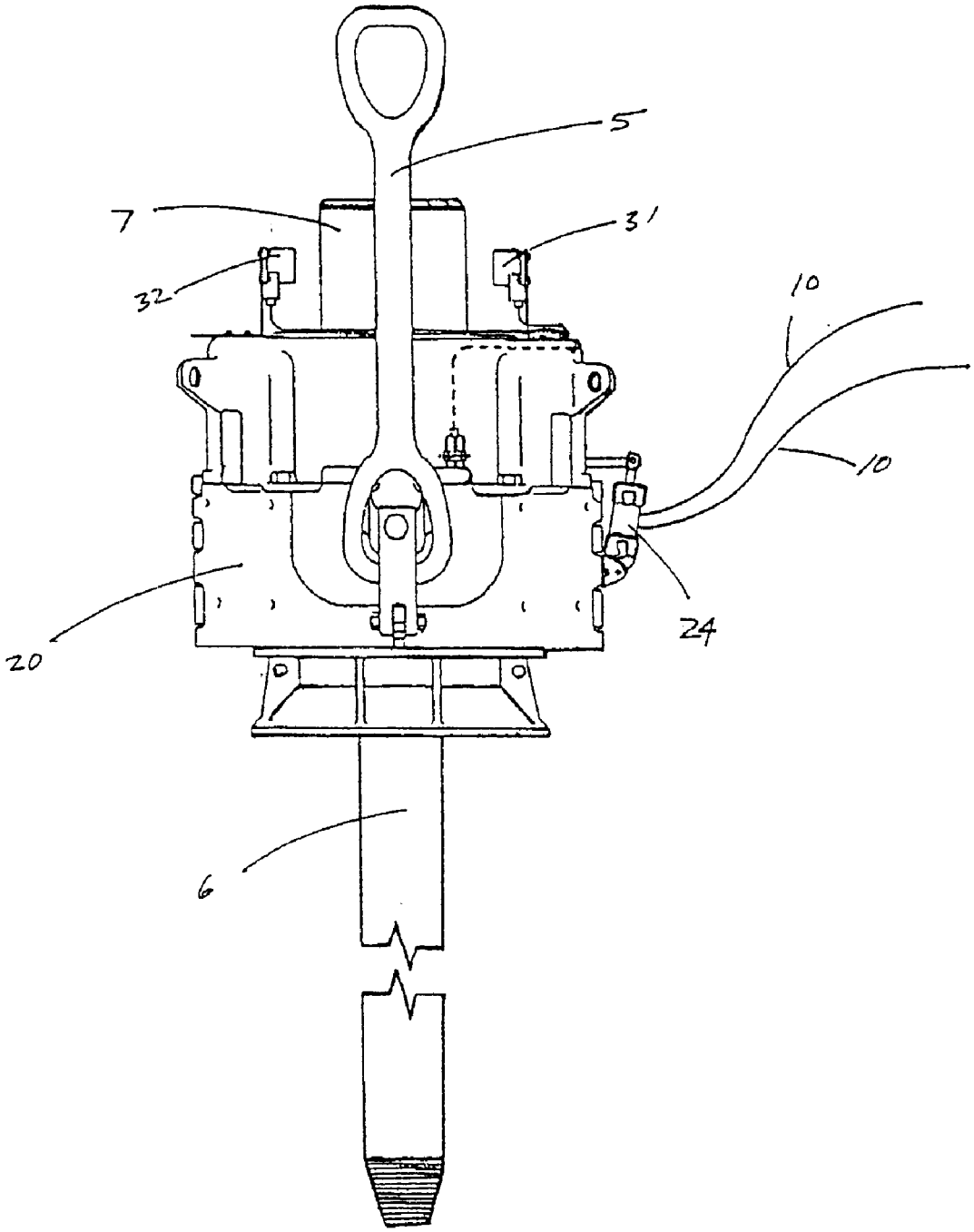
FIG. 5 is a side view of a set of elevators lowered around a section of pipe, wherein the upper portion of said pipe section extends through the central bore of said elevators.

Still referring to FIG. 4, elevators 20 have central bore 23 extending through the body of said elevators. As elevators 20 are lowered within a derrick from above pipe joint 6 via traveling block 3, said pipe joint 6 is received within central bore 23 of elevators 20. FIG. 5 depicts a side view of elevators 20 which have been lowered around pipe joint 6, such that the upper portion of said pipe joint 6, including external coupling 7, extends through the central bore of said elevators 20. In FIG. 5, the top of pipe joint 6, including large outer diameter external coupling 7, extends from the opening of central bore 23 above the upper surface of elevators 20. Elevator slips are included within elevator 20; when closed, said elevator slips engage against the outer surface of pipe joint 6. Pneumatic control 24 and pneumatic lines 10 for elevator slips 21 is shown in FIG. 4.

Referring to FIG. 4, elevators 20 have optical sensors 31 and 32 mounted on the upper surface of said elevators. Transmitting optical sensor 31 is capable of emitting an optical signal which is received by receiving optical sensor 32. Said optical sensors 31 and 32 are connected to a signaling means which can provide a signal (visual and/or audible) which can be observed by a driller and/or other operator at different locations on the rig including, in the preferred embodiment, on the rig floor.

Figure 6:
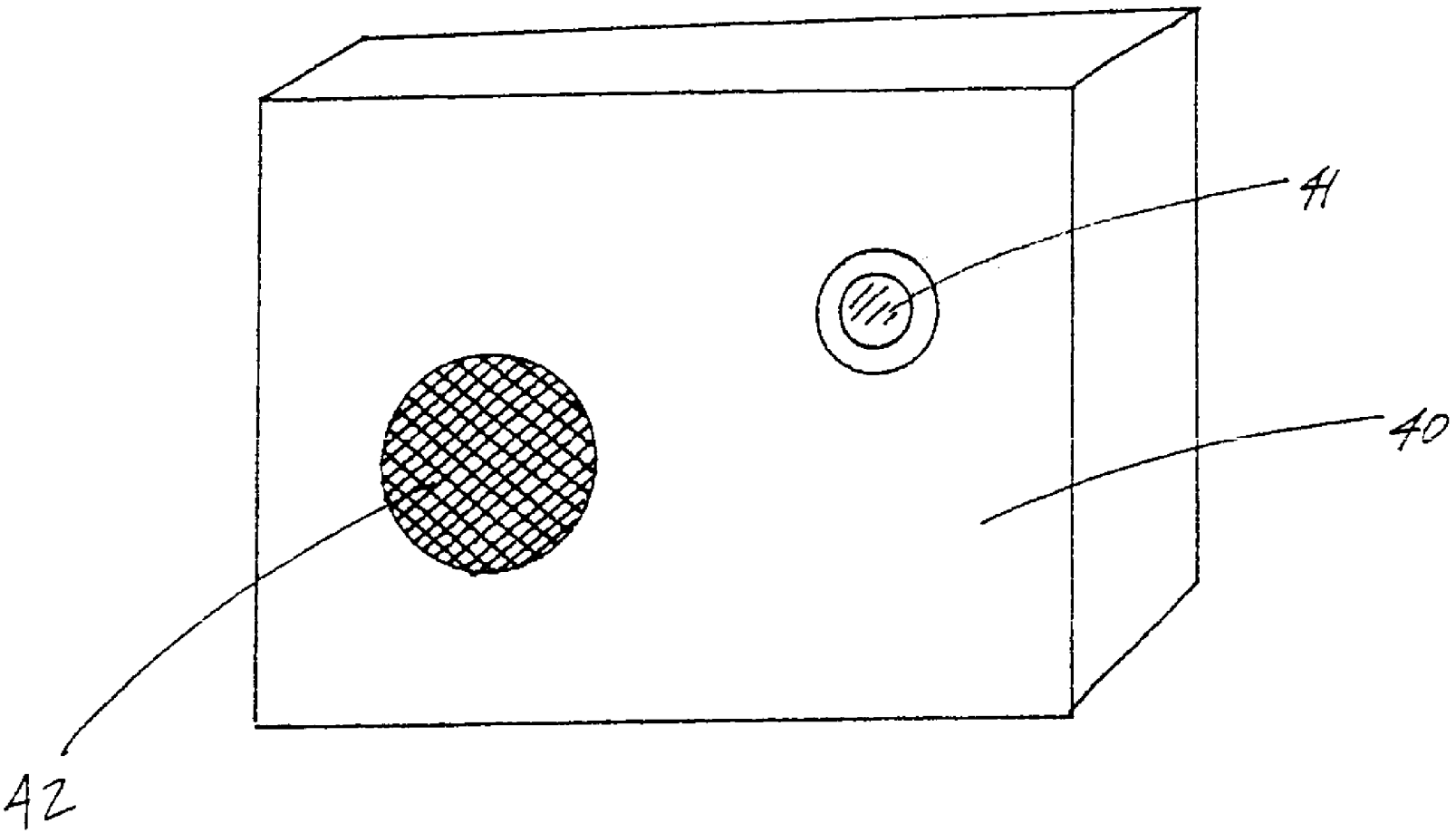
FIG. 6 is a side view of a signal panel of the present invention.

FIG. 6 depicts a signal box 40 of the present invention. When optical sensors 31 and 32 determine that elevators 20 are properly positioned relative to pipe joint 6, signal box 40 emits a signal which can be observed by a driller and/or other personnel on the rig. Such signal indicates that it is safe to actuate elevator slips 21. Such signal can be transmitted via visual light 41, or audible speaker 42, or both.

In the preferred embodiment, the apparatus of the present invention is used to install tubular pipe such as large diameter casing into a well. A first joint of pipe 6 is lowered into a wellbore at the rig floor, and suspended in place in the wellbore using a set of lower slips 8. Such lower slips 8 suspend the weight of the joint of pipe 6 in the well from the rotary table 9. The top of joint of pipe 6, which is typically equipped with a female or "box-end" threaded connection, is generally positioned a few feet above rig floor 2. Thereafter, a pipe handling machine grabs a second joint of pipe 6, lifts said second joint of pipe vertically into the derrick, positions said second joint above joint 6 which was previously run into the well, and "stabs" the male or "pin-end" thread at the bottom of said second joint of pipe into the female threads at the top of joint of pipe 6. The second joint of pipe is then rotated in order to screw the threaded connections of the two joints of pipe together.

Thereafter, elevators 20 hanging from traveling block 3 in derrick 1 are lowered over the top of the second joint of pipe. Such elevators have a central bore which is aligned with the top of the second joint of pipe. In this position, the upper end of the second joint of pipe can be 40 feet or more above rig floor 2 in derrick 1. A driller, who is located on rig floor 2, typically controls the vertical positioning of traveling block 3 and the elevators 20 attached thereto. As elevators 20 are lowered, the upper end of the second joint of pipe is received within central bore 23 of elevators 20. Elevators 20 are essentially lowered around the outer surface of the second joint of pipe.

As elevators 20 are lowered around the upper end of the second joint of pipe, said joint of pipe is received within central bore 23 of elevators 20 until the top of joint of pipe protrudes through the upper opening of said central bore 23. As elevators 20 are lowered further down said second joint of pipe, the top of said pipe eventually breaks or interrupts the optical signal emitted between optical sensors 31 and 32 which are positioned on either side of the upper opening of central bore 23. In the preferred embodiment, optical sensors 31 and 32 are an electric eye. The vertical distance between optical sensors 31 and 32, on the one hand, and elevator slips 21, on the other hand, must be greater than the length of external coupling 7. When the beam emitted by the optical sensors is broken by the top of pipe joint 6*b*, a signal (audible and/or visual) is emitted at signal box 40, thereby indicating that elevator slips 21 within elevators 20 are positioned below external coupling 7 along the tube body of said second pipe joint. Such signal indicates that elevators 20 have progressed far enough along the length of joint of pipe to ensure that the elevator slips 21 are not positioned adjacent to external coupling 7. In the preferred embodiment, signal box 40 is positioned in close proximity to a driller's console on rig floor 2, so that a driller or other worker on the rig floor can observe signals emitted from said signal box. Once it is determined that elevators 20 are properly positioned below external coupling 7, elevator slips 21 can be latched to fully engage against and grip the body of said second joint of pipe.

Once elevator slips 21 are actuated around and grip the outer surface of said second joint of pipe, the entire weight of the pipe in the well can be suspended from elevator slips 21. Traveling block 3 and elevators 20 can be raised within the derrick, thereby taking weight off of lower slips 8. Such lower slips 8 can then be removed. Once lower slips 8 are removed, the remainder of said first joint of pipe and a portion of said second joint of pipe can be then lowered into the well. After the second joint of pipe is lowered a sufficient distance into the well, lower slips 8 are again inserted in place within rotary table 9, and the process is repeated until the desired length of pipe (i.e., number of sections of pipe) is run into the wellbore.

Although preferred embodiments of the subject invention have been described herein, it should be understood that various changes, adaptations and modifications may be made therein without departing from the spirit of the invention and the scope of the appended claims.

What is claimed is:

1. An apparatus for signaling when a movable elevator having a bore therethrough is at a desired position comprising:

a. a signaling means; and b. means for actuating said signaling means when a movable elevator having a bore therethrough is located at a desired position along a section of pipe disposed within said bore.

2. The apparatus of claim 1, wherein said means for actuating said signaling means comprises one or more optical sensors.

3. The apparatus of claim 2, wherein said one or more optical sensors are mounted to the upper surface of said elevator to sense when the top of said section of pipe protrudes from the bore of said elevator.

4. The apparatus of claim 2, wherein said optical sensors comprise one or more photo electric eyes.

5. The apparatus of claim 1, wherein said signaling means comprises a light.

6. The apparatus of claim 1, wherein said signaling means comprises a horn.

7. An apparatus for signaling when a movable elevator having a bore therethrough is at a desired location comprising:

a. a signaling means;

b. means for actuating said signaling means when a section of pipe disposed through the bore of a movable elevator protrudes from the upper opening of said bore.

8. The apparatus of claim 7, wherein said means for actuating said signaling means comprises one or more optical sensors.

9. The apparatus of claim 8, wherein said one or more optical sensors comprise a photo electric eye.

10. The apparatus of claim 9, wherein said signaling means comprises a light.

11. The apparatus of claim 9, wherein said signaling means comprises a horn.

12. An apparatus for signaling when a movable elevator having a bore having an upper opening and a lower opening extending therethrough and pipe gripping slips is at a desired location comprising:

a. a signaling means;

b. one or more optical sensors mounted to the upper surface of said elevator; and c. means for actuating said signaling means when said one or more optical sensors sense that a section of pipe disposed through said bore protrudes from the upper opening of said bore.

13. The apparatus of claim 12, wherein the vertical distance between said optical sensors and the pipe gripping slips of said movable elevator is greater than the length of an external coupling at the upper end of said section of pipe.

14. The apparatus of claim 13, wherein said optical sensors comprise one or more photo electric eyes.

* * * * *